US006422824B1

(12) United States Patent
Lee et al.

(10) Patent No.: US 6,422,824 B1
(45) Date of Patent: Jul. 23, 2002

(54) GETTING ASSEMBLY FOR VACUUM DISPLAY PANELS

(75) Inventors: Cheng-Chung Lee, Chutung Hsinchu; Ruey-Feng Jean, Hsinchu, both of (TW)

(73) Assignee: Industrial Technology Research Institute, Hsin Chu (TW)

( * ) Notice: Subject to any disclaimer, the term of this patent is extended or adjusted under 35 U.S.C. 154(b) by 0 days.

(21) Appl. No.: 09/396,534

(22) Filed: Sep. 15, 1999

(51) Int. Cl.[7] ..... F04B 37/02

(52) U.S. Cl. ..... 417/48; 313/553; 313/554; 313/556; 313/558; 313/559; 313/562; 417/48; 417/51

(58) Field of Search ..... 313/545, 553, 313/554, 555, 556, 558, 559, 560, 562; 417/48, 51

(56) References Cited

U.S. PATENT DOCUMENTS 3,979,166 A * 9/1976 Zucchinelli ..... 417/48
5,789,859 A * 8/1998 Watkins et al. ..... 313/559 X
5,964,630 A * 10/1999 Slusarczuk et al. ..... 313/554 X

* cited by examiner

*Primary Examiner*—Ashok Patel
(74) *Attorney, Agent, or Firm*—Randy W. Tung

(57) ABSTRACT

A getter assembly for use in a vacuum display panel is described. The novel getter assembly can be provided including both a non-evaporative getter and an evaporative getter which are uniquely positioned juxtaposed to each other such that ions emitted by the evaporative getter upon activation substantially shield the non-evaporative getter so that gases emitted by the non-evaporative getter when activated does not affect the state of vacuum in the vacuum display panel. A preferred embodiment of the present invention novel getter assembly is shown for vacuum display panels that have sufficient thickness in the cavity so that the getter assembly can be installed inside the cavity. An alternate embodiment of the present invention illustrates that when the cavity in the vacuum display panel is too small to accommodate the mounting of the getter assembly, an exterior mounting of the assembly is possible wherein one of the getters may be activated by a radio frequency induced current, instead of by feedthrough electrodes. By utilizing the present invention novel getter assembly which is uniquely positioned to compliment each other's functions, a high and stable vacuum state in a vacuum display panel device can be achieved and maintained, for instance, at between $10^{-6}$ and $10^{-7}$ Torr.

17 Claims, 3 Drawing Sheets

GETTING ASSEMBLY FOR VACUUM DISPLAY PANELS

FIELD OF THE INVENTION

The present invention generally relates to a getter assembly for use in a vacuum display panel and more particularly, relates to a getter assembly for use in a vacuum display panel that consists of a non-evaporative getter and an evaporative getter positioned juxtaposed to each other such that ions emitted by the evaporative getter upon activation substantially shields the non-evaporative getter so that gases emitted by the non-evaporative getter upon activation does not affect a state of vacuum in the display panel.

BACKGROUND OF THE INVENTION

In the fabrication of vacuum display devices such as FED (field emission device), PDD (plasma display device) and VFD (vacuum fluorescence display) etc., the degree of high vacuum achieved in a cavity of the device directly affects the quality and the lifetime of the device. Achieving a high vacuum in such devices is therefore an utmost important condition in fabricating devices of high quality and reliability. An effective means for reducing or eliminating residual gases in the cavity of the device, in turn, determines the degree of high vacuum that can be achieved. These gases may include $H_2$, $CO_2$, CO, $H_2$ or any other gases emitted during the tip-off process from the molten glass and any other gases that tend to chemically absorb to the surfaces of the components in the device.

In most vacuum display devices, electrons are emitted from electron emitters such as microtips in a FED device for generating the display. When residual gases exist in the cavity of the device, the emitted electrons cause ionization of the residual gases which not only reduces the efficiency of the device, but also causes arcing problem resulting in serious damage to the device.

In the fabrication of vacuum display devices, a vacuum between about $10^{-6}$ and $10^{-7}$ Torr is normally required in order for the device to function properly. For instance, when a FED device is fabricated between two glass plates in which an upper glass plate is coated with a fluorescent coating on an inside surface and the lower glass plate is formed with a multiplicity of microtips on an inside surface, and after the upper and the lower glass plates are fused together by side panels of glass (by a fusing agent such as glass frit), at least one vent tube is left open for the lip final withdrawal of air and gases from the cavity by a vacuum pump. During the vacuum withdrawal process, the cavity is pumped by a high vacuum pump while the device baked at a temperature between 300~400° C. for several hours. The pumping and the baking process normally get rid of most gases in the cavity, however, some gases which have strong absorption characteristics are attached to the device walls (especially at the bake temperature) and cannot be eliminated. Thus, after the vent tubes are sealed, the minute amount of residual gases cause a drop in the vacuum and furthermore, may cause ionization when bombarded by the electrons leading to severe damages to the device.

The residual gases in the cavity of a vacuum display device have been investigated to determine their sources or origin. One of the main sources of the residual gases is the molten glass material during the sealing or the tip-off of the vent tubes. Another major source of the residual gases is the material that is used to form the microtips, in the case of a field emission display device. It has been found that the microtip material tends to absorb gases that cannot be released at the normal bake temperature of 300~400° C. Since it is impossible to completely eliminate the residual gases in a vacuum display device cavity after the device is sealed from the atmosphere, methods and devices for eliminating such residual gases after tip-off have been developed to resolve the outgassing problem occurred in the fabrication of such devices.

Getter materials are first developed to meet the needs of high vacuum during the process and the life of electron tubes many years ago. Pure barium encapsulated in iron or nickel tubes of small diameters was first utilized for such purpose. A compound of barium-thorium was also used for getters in the early development stage of the material. More recently developed getter materials can be classified into the categories of the evaporative getters (EG) and the non-evaporative getters (NEG). The most popular materials used as evaporative getters are Ba and Ti. For instance, Ba has been widely used in electronic applications such as CRT tubes. Ba is frequently used in the form of a compound of Ba/Al, such as $BaAl_4$, an intermetallic compound. A typical Ba/Al compound is supplied commercially by the SAES Company of Milan, Italy.

In more recently developed electronic devices which utilize higher power, the high operating temperature and the high voltage make the use of evaporative type getter materials such as barium impossible. The non-evaporative getter materials become necessary and are developed for such use. A typical non-evaporative getter can be a thin layer of zirconium or titanium powder deposited on an anode strip. Metal alloys that contain zirconium or titanium such as a zirconium-aluminum alloy have also been developed for use as non-evaporative getters.

The getter materials normally require activation by an electrical current in order to function as a gas absorber. An activated and unsaturated getter surface readily reacts with residual gases that normally present in vacuum display devices which includes $H_2$, $H_2O$, CO, $CO_2$, $N_2$ and $O_2$. When evaporative getters are utilized, activation is achieved by evaporating the getter material and thus creating a fresh unsaturated metallic film that readily absorbs gases by a chemical reaction. The function of the non-evaporative getters is more complex which normally involves an activation process carried out by properly heating the getter material and promoting a bulk diffusion of oxygen of a passivating surface layer until the surface is sufficiently clean to start absorbing the impinging gases.

The evaporative getter materials, i.e., frequently barium-containing materials, operate in a temperature range of 800° C.~1200° C. from an alloy that releases vapor of the metal getter material. The non-evaporative getter materials normally operate at different temperature ranges which consist of alloys based on titanium and/or zirconium. The evaporative and non-evaporative getter materials each having its own characteristics and benefits that are not achievable by the other. The combined use of EG and NEG therefore presents unique advantages that combines both that offered by the EG and the NEG. Even though the combination use of EG and NEG has been attempted by others, no effort has ever been made in the positioning of the two different types of getter materials in order to achieve an optimum result in absorbing residual gases in a vacuum device.

It is therefore an object of the present invention to provide a getter assembly for use in a vacuum display panel that does not have the drawbacks or shortcomings of the conventional getter assemblies.

It is another object of the present invention to provide a getter assembly for use in a vacuum display panel wherein the EG and NEG are uniquely positioned to compliment the function of each getter and to achieve an optimum result.

It is a further object of the present invention to provide a getter assembly for use in a vacuum display panel wherein an evaporative getter is positioned juxtaposed to a non-evaporative getter in a cavity of the device.

It is still another object of the present invention to provide a getter assembly for use in a vacuum display device wherein an evaporative getter and a non-evaporative getter are positioned juxtaposed to each other while each is connected to an electrode for activating by an electrical current.

It is still another object of the present invention to provide a getter assembly for use in a vacuum display device wherein an evaporative getter and a non-evaporative getter are both mounted inside a cavity of the device juxtaposed to each other.

It is yet another object of the present invention to provide a getter assembly for use in a vacuum display device wherein both an evaporative getter and a non-evaporative getter are mounted outside a cavity of the device in an enclosure which is in fluid communication with the cavity.

It is still another further object of the present invention to provide a getter assembly for use in a vacuum display device wherein a non-evaporative getter is activated by electrode means while an evaporative getter is activated by radial frequency (RF) induced current.

It is yet another flirther object of the present invention to provide a vacuum display panel that utilizes a getter assembly in a cavity of the panel that includes a non-evaporative getter and an evaporative getter positioned juxtaposed to each other such that ions emitted by the evaporative getter upon activation substantially shield the non-evaporative getter so that gases emitted by the non-evaporative getter when activated does not affect a vacuum state in the cavity of the display panel.

SUMMARY OF THE INVENTION

In accordance with the present invention, a getter assembly for use in a vacuum display panel is provided.

In a preferred embodiment, a getter assembly for a vacuum display panel is provided which includes a first getter of the non-evaporative type electrically connected to a first electrode for activating the getter, and a second getter of the evaporative type electrically connected to a second electrode for activating the getter, the second getter is positioned juxtaposed to the first getter and in such a way that ions emitted by the second getter upon activation substantially shield the first getter such that gases emitted by the first getter when activated does not affect a vacuum state in the vacuum display panel.

In the getter assembly for a vacuum display panel, the second getter of the evaporative type is positioned juxtaposed to the first getter of the non-evaporative type so that ions emitted by the second getter substantially surround the first getter. The second getter of the evaporative type forms a coating layer on the inside surfaces of an upper and a lower glass plate that form the vacuum display panel. The second getter of the evaporative type may be mounted on a tip portion of the second electrode for making electrical contact. The first getter and the second getter may be mounted in a cavity formed between two glass plates of the vacuum display panel. The first getter of the non-evaporative type may be mounted on a tip portion of the first electrode. The first and the second getter are activated through the first and the second electrode, respectively by an electrical current of less than 10 amp. The first getter of the non-evaporative type may be formed of a material including Ti or Zr. The second getter of the evaporative type may be formed of a material including Ba. The first and the second getter maintains a vacuum in the vacuum display panel of at least $10^{-6}$ Torr when activated.

In another preferred embodiment, a getter assembly for a flat panel display (FPD) unit is provided which includes a first getter of the non-evaporative type mounted inside the insulating enclosure electrically connected to a feedthrough electrode for activation that houses the first getter, and a second getter of the evaporative type that is activated by a RF electrode coil mounted on the outside wall of an electrically insulating enclosure, the second getter may be positioned juxtaposed to the first getter such that ions emitted by the second getter upon activation shield the first getter and gases emitted by the first getter upon activation so as not to effect a vacuum pressure in the FPD unit by a factor of more than 100, the electrically insulating enclosure may be integrally attached to and in fluid communication with a cavity in the FPD unit.

In the getter assembly for a flat panel display unit, the electrically insulating enclosure may be a bell-shaped glass dome. The first getter of the non-evaporative type may be suspended in the electrically insulating enclosure in a spaced-apart relationship with the FPD unit. A coating layer may be formed by the second getter on an inside wall of the electrically insulating enclosure upon activation of the second getter. The second getter may be positioned suspended over the first getter in the electrically insulating enclosure. The electrically insulating enclosure may be fused to the FPD unit by glass frit. The electrically insulating enclosure may be in fluid communication with the cavity in the FPD unit through an aperture formed in a top wall of the FPD unit.

The present invention is further directed to a vacuum display panel that includes a top glass plate coated with a fluorescent material on an inside surface, a bottom glass plate that has a multiplicity of electron emitters formed on an inside surface, side panels joining the top and bottom glass plates forming a vacuum-tight cavity therein, and an electrically insulating enclosure integrally joined to the top glass plate, a cavity in the enclosure in fluid communication with the vacuum-tight cavity through an aperture provided in the top glass plate, wherein the electrically insulating enclosure further includes a getter assembly including a first non-evaporative getter and a second evaporative getter, the first non-evaporative getter is electrically connected to a first electrode for activation, the second evaporative getter is electrically connected to a second electrode for activation, the second getter may be positioned juxtaposed to the first getter and in such a way that ions emitted by the second getter upon activation substantially shield the first getter such that gases emitted by the first getter upon activation does not affect a vacuum state in the vacuum display panel.

In the vacuum display panel, the second getter of the evaporative type may be positioned juxtaposed to the first getter of the non-evaporative type such that ions emitted by the second getter substantially surround the first getter. The second getter of the evaporative type may form a coating layer on the inside surfaces of an upper and a lower glass plate that form the vacuum display panel. The second getter of the evaporative type may be mounted on a tip portion of the second electrode for making electrical contact. The first getter of the non-evaporative type may be mounted on a tip portion of the first electrode. The second getter of the evaporative type may be formed of a material including Ba.

The first getter of the non-evaporative type may be formed of a material including Ti or Zr. The first and the second getter maintain a vacuum in the vacuum display panel of at least $10^{-6}$ Torr when activated.

BRIEF DESCRIPTION OF THE DRAWINGS

These and other objects, features and advantages of the present invention will become apparent from the following detailed description and the appended drawings in which.

DETAILED DESCRIPTION OF THE PREFERRED AND ALTERNATE EMBODIMENTS

The present invention discloses a getter assembly for use in a vacuum display panel such as a FED, a PDD, or a VFD device. The novel getter assembly includes a non-evaporative type getter and an evaporative type getter that are positioned in the same panel cavity, and furthermore, arranged in unique positions such that ions emitted by the evaporative getter upon activation substantially shield the non-evaporative getter so that gases emitted by the non-evaporative getter when activated do not affect a state of vacuum in the vacuum display panel. When the present invention novel getter assembly is utilized in a vacuum display device, a superior vacuum of at least $10^{-6}$ Torr can be achieved and maintained.

The present invention novel getter assembly can be provided in various configurations. While two of the configurations are shown here in a preferred and in an alternate embodiment, the present invention novel device is no way limited to such two configurations. Any other configuration can be utilized as long as a coating layer from the evaporative getter can be formed to substantially surround a non-evaporative getter and thus absorbing any gas evolved from the non-evaporative getter when the latter is activated.

Figure 1:
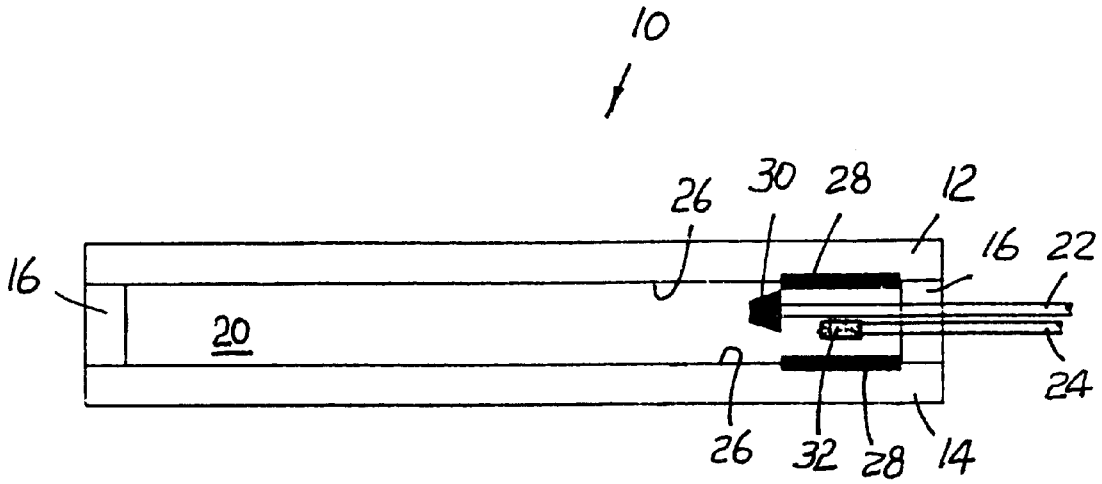
FIG. 1 is a cross-sectional view of a preferred embodiment of the present invention vacuum display panel having the getter assembly mounted therein.

The evaporative getter can be suitably supplied in any compound that contains Ba such that Ba ions are emitted from the getter when activated by an electrical current. The non-evaporative getter may be any compound that contains zirconium, titanium or any other suitable metallic material. When the getter assembly is installed inside a cavity of a flat panel display device, as shown in FIG. 1, the non-evaporative getter and the evaporative getter are each connected to an electrode, i.e., a feedthrough electrode formed of a metallic alloy of Fe, Ni and Cr. The alloy is formed of metals that have similar coefficient of thermal expansion such that it functions properly in a broad temperature range suitable for vacuum display panel applications.

The present invention novel getter assembly may be mounted, as shown in an alternate embodiment, on the outside of a flat panel display unit. When such mounting is utilized, a substantially bell-shaped insulating dome is integrally connected to the flat panel display. A cavity in the insulating dome is in fluid communication with a cavity in the flat panel display through an aperture provided in a top glass panel of the flat panel display device. When such configuration is used, the non-evaporative getter assembly can be activated by a feedthrough electrode, while the evaporative getter can be activated by a radio frequency induced current generated by a RF coil mounted outside the insulating enclosure. The present invention novel getter assembly can therefore be activated by either an electrical current or a radio frequency induced current. In the case of a non-evaporative getter, when the getter powder that contains titanium, zirconium or both becomes activated, the powder traps residual gas in the cavity of the vacuum display chamber onto the surface layer of the powder. In the case of an evaporative getter formed of an alloy of Ba/Al, Ba ions are produced upon heating of the getter to trap residual gases in the cavity of the chamber.

It should be noted that in the conventional method of utilizing both a non-evaporative getter and an evaporative getter in a vacuum device, the positioning of the getters has not been considered. It is only the unique discovery of the present invention that since the absorption by Ba ions functions in a passive manner, i.e., the Ba ions are of large size and therefore are not very active, the residual gas to be absorbed must approach the ions in order for the absorption process to take effect. Since the NEG powder normally has large surface areas, the absorption rate by the NEG powder is high. In a typical absorption process by the getter assembly, the evaporative getter is first utilized and activated, the non-evaporative getter is then activated which let out gases during its operation. When the two getters, i.e., the evaporative and the non-evaporative, are positioned far away, gases let out by the non-evaporative getter, even though at a small amount, cannot be absorbed by the Ba ions from the evaporative getter. For instance, this typically occurs in a FED panel and degrades the state of high vacuum in the panel cavity. It is only with the present invention novel getter assembly, which is uniquely positioned for the EG and NEG to shield each other, the residual gas problem in a vacuum display panel can be significantly reduced or completely eliminated.

Referring now to FIG. 1, wherein a cross-sectional view of a present invention vacuum display panel 10 is shown. The vacuum display panel 10 is constructed by an upper glass panel 12, a lower glass panel 14, side glass panels 16 which are fused together by glass frit. The panels 12, 14 and 16 form a cavity 20 therein for the vacuum display device 10. At one end of the cavity 20, feedthrough electrodes 22, 24 are provided through the side panel 16. At the tip portion of the electrode 22, an evaporative getter 30 is formed. Similarly, at the tip portion of the electrode 24, a non-evaporative getter 32 is provided. An electrical current of less than 10 amp, or in the range between 1 amp and 10 amp can be used to activate the EG 30 or the NEG 32. Upon activation of the EG 30, EG coating layers 28 are formed on the inside walls 26 of the upper glass plate 12 and the lower glass plate 16 substantially surrounding the non-evaporative gather 32. These coatings 28 are formed substantially of Ba ions when a Ba containing material is used for the evaporative getter 30. The electrodes 22, 24 may be suitably formed of a metallic alloy such as Fe NiCr wherein each component has a similar coefficient of expansion compared to the other components.

Figure 3:
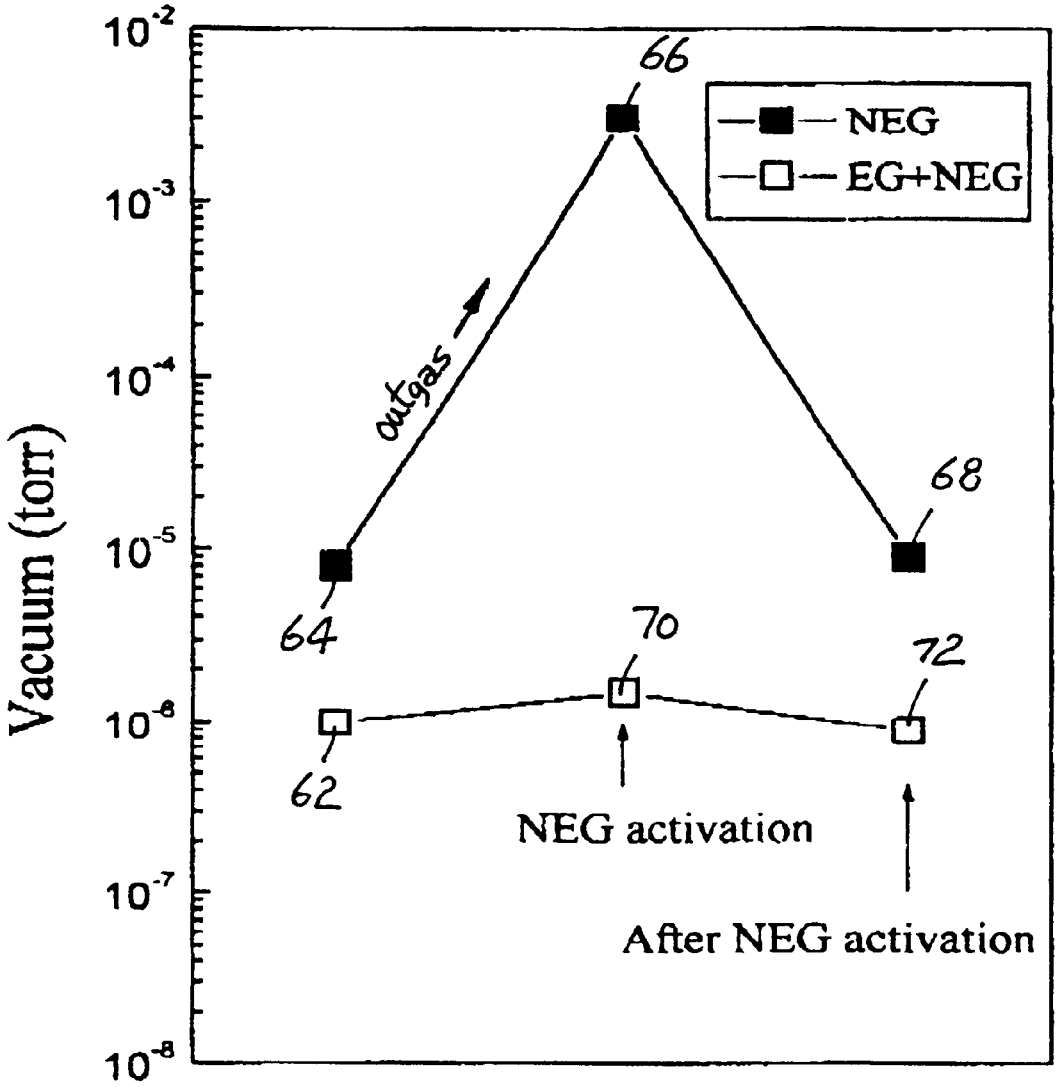
FIG. 3 is a graph illustrating the short-term performance of the present invention novel getter assembly.

In the preferred embodiment of the present invention getter assembly shown in FIG. 1, when the cavity 20 of the vacuum display device 10 is first sealed or tipped-off, as indicative by points 62 and 64 in FIG. 3, the vacuum at point 64 increases to point 66 in a conventional getter assembly wherein only a non-evaporative gather is utilized. The loss of vacuum is indicative of an outgassing process taken place during the time period. Contrary to the conventional getter device, the present invention novel getter assembly which is sealed at point 62 with the evaporative getter activated, there is no significant loss of vacuum at point 70. At the point of time shown by points 66, 70, the non-evaporative getter is activated in both the conventional getter and the present invention novel getter assembly. It is seen that the vacuum condition in the chamber with conventional NEG getter only is improved to point 68, i.e., only slightly higher in pressure than point 64. In the chamber equipped with the present invention novel getter assembly, after the activation of the non-evaporative getter at point 70, the vacuum pressure is further improved at point 72 due to the effective absorption by the NEG activation.

It should be noted that the data shown in FIG. 3 is obtained on a short-term basis, i.e., approximately between 1 and 3 minutes at between point 70 and point 72. The activation of the non-evaporative getter at points 66 and 70 is effectuated by flowing an electrical current of approximately 5 amp DC through the non-evaporative getter. The desirable effect of the present invention novel getter assembly is therefore illustrated in FIG. 3. With the present invention novel getter assembly in place, only a minimal or essentially unnoticeable pressure change occurs in the vacuum display chamber. This is in great contrast to the chamber equipped with a conventional non-evaporative getter wherein a large fluctuation in pressure occurs which inevitably affects the performance of the vacuum display panel. In the data shown by points 64, 66 and 68 for the chamber containing the conventional getter device, the non-evaporative getter either works alone or is not positioned according to the teachings of the present invention.

Figure 4:
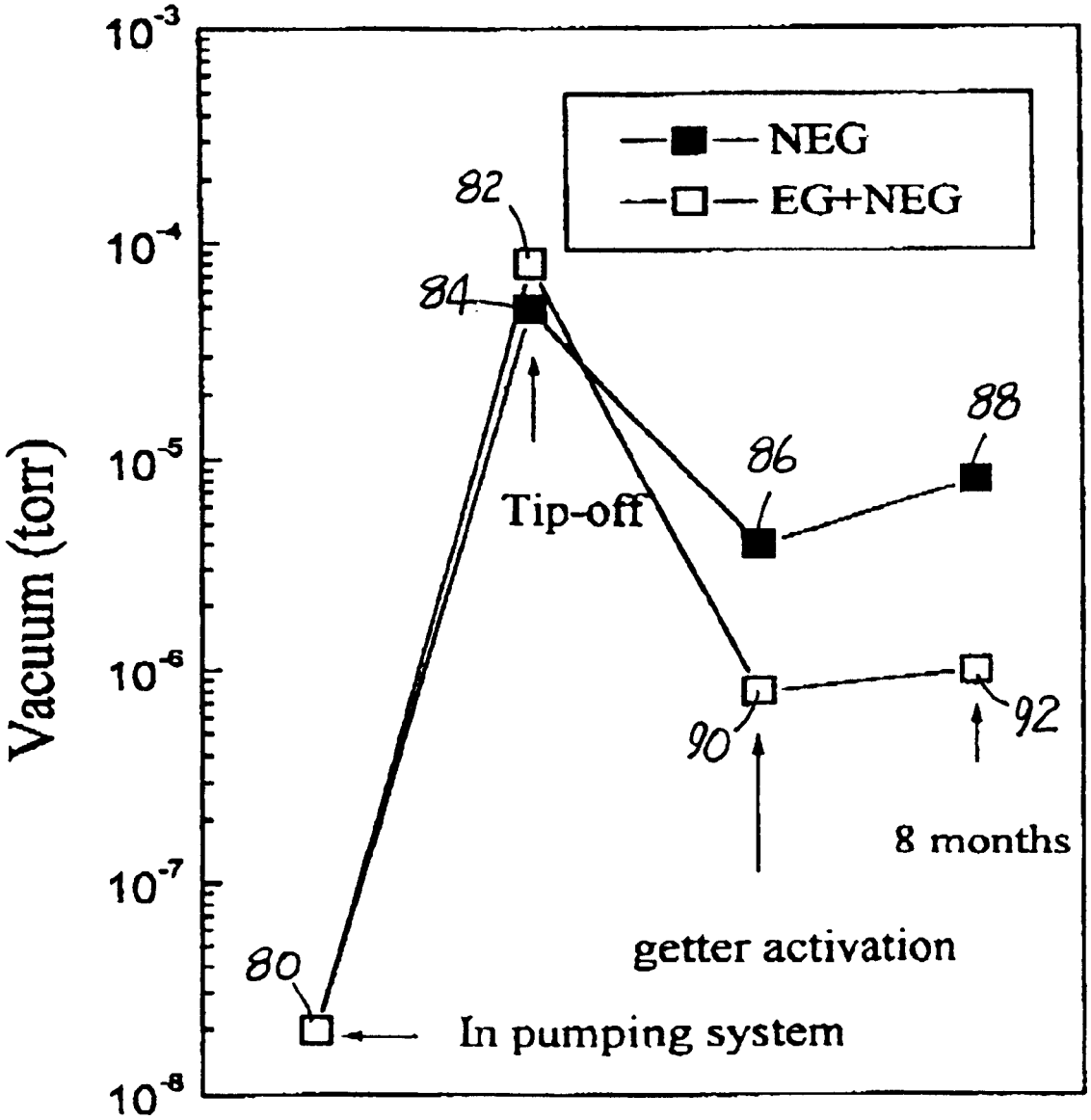
FIG. 4 is a graph illustrating the long-term performance of the present invention novel getter assembly.

The long term performance of the present invention novel getter assembly is shown in FIG. 4. Again, a conventional getter used in a vacuum display panel device and a present invention novel getter assembly similarly used are shown for comparison. At point 80, the pumping starts for the vacuum display chamber cavity which brings down the chamber pressure by approximately four folds to points 82 and 84. At points 82, 84, the tip-off process is conducted to seal the cavity in the vacuum display panel which results in an improved vacuum for the conventional chamber at point 86. After an elapsed time of 8 months, the chamber pressure of the conventional chamber increases significantly to point 88 resulting in a degradation of the performance of the vacuum display panel. In contrast to the chamber that contains the conventional non-evaporative getter, the present invention novel getter assembly shows a significantly higher efficiency in absorbing residual gases in the cavity at point 90 after the getter assembly is activated and the tip-off at point 82. After the elapsed time of 8 months, the vacuum at point 90 only suffers a small degradation to point 92. The effectiveness of the present invention novel getter assembly can therefore be readily identified in FIG. 4 illustrating the long-term performance of the getter assembly.

Figure 2:
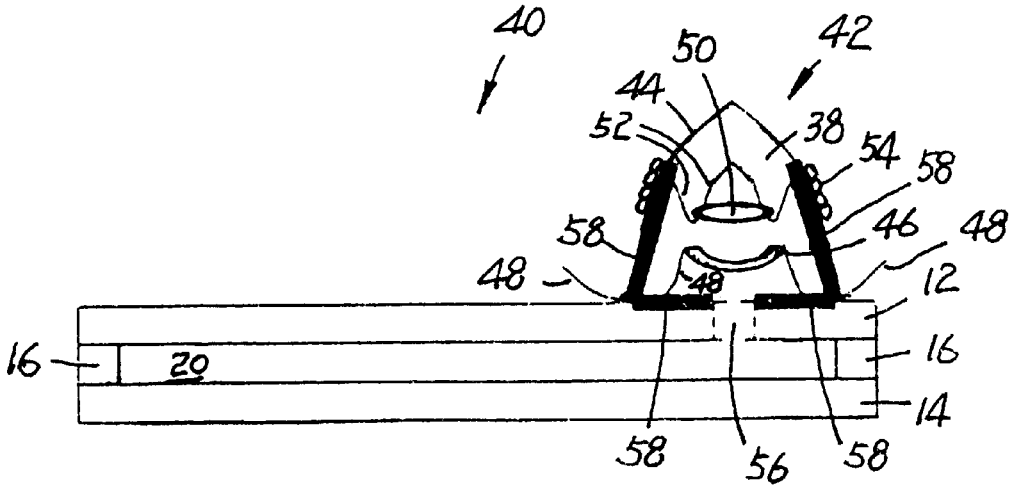
FIG. 2 is a cross-sectional view of an alternating embodiment of the present invention having a getter assembly mounted in an enclosure outside the vacuum display panel.

In an alternate embodiment, shown in FIG. 2, a present invention vacuum display panel device 40 is shown. The vacuum display panel device 40 is constructed similar to that shown in FIG. 1, i.e., by the upper glass panel 12, the lower glass panel 14 and side glass panels 16 in forming a cavity 20 therein. In the vacuum display device 40, it is shown that the cavity 20 is significantly smaller, i.e., narrower between the top and bottom glass plates 12, 14 than that of the vacuum display panel 10 of FIG. 1.

Based on the smaller cavity 20 shown in FIG. 2, there is no space in the cavity for the mounting of a getter assembly 42. The getter assembly 42 is therefore mounted on top of the upper glass plate 12 and exterior to the vacuum display panel device 40. The getter assembly 42 can be suitably enclosed in an insulating enclosure 44, such as that made of glass. A non-evaporative getter 46 is suspended in the cavity 38 of the insulating enclosure 44. The non-evaporative getter 46 can be activated by the electrical connection made by feedthrough electrodes 48. On top of and spaced-apart from the non-evaporative getter 46, is suspended an evaporative getter 50 that is also suspended by insulating wires 52. Since it is difficult to activate the evaporative getter 50 by traditional means, i.e., by feedthrough electrodes that are normally used, the evaporative getter 50 is activated by RF coils 54 provided on the outside wall of the insulating enclosure 44. The electrical connections to the RF coil 54 are not shown for simplicity reason.

To provide fluid communication between the cavity 38 in the insulating enclosure 44 and cavity 20 in the vacuum display panel device 40, an aperture 56 is provided in the upper glass plate 12. When the getter assembly 42 is operated by first activating the evaporative getter 50, a coating layer 58 is formed on the inside wall of the insulating enclosure 44. The coating layer is formed of Ba ions when a Ba containing material is used as the evaporative getter 50. It is shown, in FIG. 2, that not only the coating layer 58 is formed on the sidewalls inside the enclosure 44, it is also formed on the floor of the enclosure 44 while exposing the aperture 56. The coating layer 54 therefore effectively surrounds the non-evaporative getter 46 and effectively captures any undesirable gases evolved from NEG 46 when it is activated through the feedthrough electrodes 48. One of may such undesirable gases is $H_2$.

The getter assembly 42 shown in FIG. 2, in an alternate embodiment of the present invention, functions and produces the same desirable effect of the present invention preferred embodiment shown in FIG. 1. It is especially suitable for use in vacuum display panels that are thinner and therefore has narrower gap in the cavity. In mounting the getter assembly 42 onto a vacuum display panel device 40, an additional small space outside the panel device 40 is required to accommodate the insulating enclosure 44. The insulating enclosure 44 is normally fused to the upper glass plate 12 of the vacuum display panel device 40 by a suitable means for achieving high vacuum such as by glass frit.

The present invention novel apparatus, shown in a preferred and in an alternate embodiment, has therefore been amply described in the above descriptions and in the appended drawings of FIGS. 1, 2, 3 and 4.

While the present invention has been described in an illustrative manner, it should be understood that the terminology used is intended to be in a nature of words of description rather than of limitation.

Furthermore, while the present invention has been described in terms of a preferred and alternate embodiment, it is to be appreciated that those skilled in the art will readily apply these teachings to other possible variations of the inventions.

The embodiment of the invention in which an exclusive property or privilege is claimed are defined as follows:

1. A getter assembly for a vacuum display panel comprising:

a first getter of the non-evaporative type electrically connected to a first electrode for activating said getter, and a second getter of the evaporative type electrically connected to a second electrode for activating said getter, said second getter being positioned juxtaposed to said first getter and in such a way that ions emitted by said second getter upon activation substantially shield said first getter such that gases emitter by said first getter upon activation does not affect a vacuum state in said vacuum display panel.

2. A getter assembly for a vacuum display panel according to claim 1, wherein said second getter of the evaporative type being positioned juxtaposed to said first getter of the non-evaporative type such that ions emitted by said second getter substantially surround said first getter.

3. A getter assembly for a vacuum display panel according to claim 1, wherein said second getter of the evaporative type forms a coating layer on inside surfaces of an upper and a lower glass plate that form said vacuum display panel.

4. A getter assembly for a vacuum display panel according to claim 1, wherein said second getter of the evaporative type being mounted on a tip portion of said second electrode for making electrical contact.

5. A getter assembly for a vacuum display panel according to claim 1, wherein said first getter and said second getter are mounted in a cavity formed between two glass plates of said vacuum display panel.

6. A getter assembly for a vacuum display panel according to claim 1, wherein said first getter of the non-evaporative type is mounted on a tip portion of said first electrode.

7. A getter assembly for a vacuum display panel according to claim 1, wherein said first and said second getter are activated through aid first and said second electrode, respectively by an electrically current of less than 10 Amp.

8. A getter assembly for a vacuum display panel according to claim 1, wherein said first getter of the non-evaporative type being formed of a material comprising Ti or Zr.

9. A getter assembly for a vacuum display panel according to claim 1, wherein aid second getter of the evaporative type being formed of a material comprising Ba.

10. A getter assembly for a vacuum display panel according to claim 1, wherein said first and said second getter maintains a vacuum in said vacuum display panel of at least $10^{-6}$ Torr when activated.

11. A getter assembly for a flat panel display (FPD) unit comprising:

a first getter of the non-evaporative type mounted inside said insulating enclosure electrically connected to a feedthrough electrode for activation that houses said first getter, and a second getter of the evaporative type being activated by a RF electrode coil mounted on the outside wall of an electrically insulating enclosure, said second getter being positioned juxtaposed to said first getter such that ions emitted by said second getter upon activation shield said first getter and gases emitted by said first getter upon activation so as not to affect a vacuum pressure in said FPD unit by a factor of more than 100, said electrically insulating enclosure being integrally attached to and in fluid communication with a cavity in said FPD unit.

12. A getter assembly for a flat panel display unit according to claim 11, wherein said electrically insulating enclosure being bell-shaped glass dome.

13. A getter assembly for a flat panel display unit according to claim 1, wherein said first getter of the non-evaporative type is suspended in said electrically insulating enclosure in a spaced-apart relationship with said FPD unit.

14. A getter assembly for a flat panel display unit according to claim 11, wherein a coating layer being formed by said second getter on an inside wall of said electrically insulating enclosure upon activation of said second getter.

15. A getter assembly for a flat panel display unit according to claim 11, wherein said second getter being positioned suspended over said first getter in said electrically insulating enclosure.

16. A getter assembly for a flat panel display unit according to claim 11, wherein said electrically insulating enclosure being fused to said FPD unit by glass frit.

17. A getter assembly for a flat panel display unit according to claim 11, wherein said electrically insulating enclosure being in fluid communication with said cavity in said FPD unit through an aperture formed in a top wall of said FPD unit.

* * * * *